United States Patent [19]

Morris

[11] Patent Number: 5,024,386

[45] Date of Patent: Jun. 18, 1991

[54] TIRE CONVERTING APPARATUS AND METHOD

[75] Inventor: Alvin L. Morris, Warren, Mich.

[73] Assignee: PFM, Inc., Detroit, Mich.

[21] Appl. No.: 354,148

[22] Filed: May 18, 1989

[51] Int. Cl.[5] ..... B02C 19/12

[52] U.S. Cl. ..... 241/3; 241/24; 241/101.4; 241/DIG. 31

[58] Field of Search ..... 241/101.7, 3, 101.4, 241/24, DIG. 31, 242, 243, 222

[56] References Cited

U.S. PATENT DOCUMENTS 3,364,526 1/1968 Varady et al. ..... 241/DIG. 31 X
3,721,392 3/1973 Burwell .
3,913,850 10/1975 Daniel .
4,015,782 4/1977 Granite .
4,052,013 10/1977 Ehrlich et al. .
4,113,186 9/1978 Smith ..... 241/DIG. 31 X
4,422,581 12/1983 Chryst .

*Primary Examiner*—Mark Rosenbaum
*Attorney, Agent, or Firm*—Brooks & Kushman

[57] ABSTRACT

A method and apparatus for shredding tires comprises debeading the tire, cutting it diametrically into segments, and then spreading the sidewalls apart while flattening each segment and feeding the segment into a shredding cutter causing the shredding of the tire while the segment is held in a flattened condition.

18 Claims, 6 Drawing Sheets

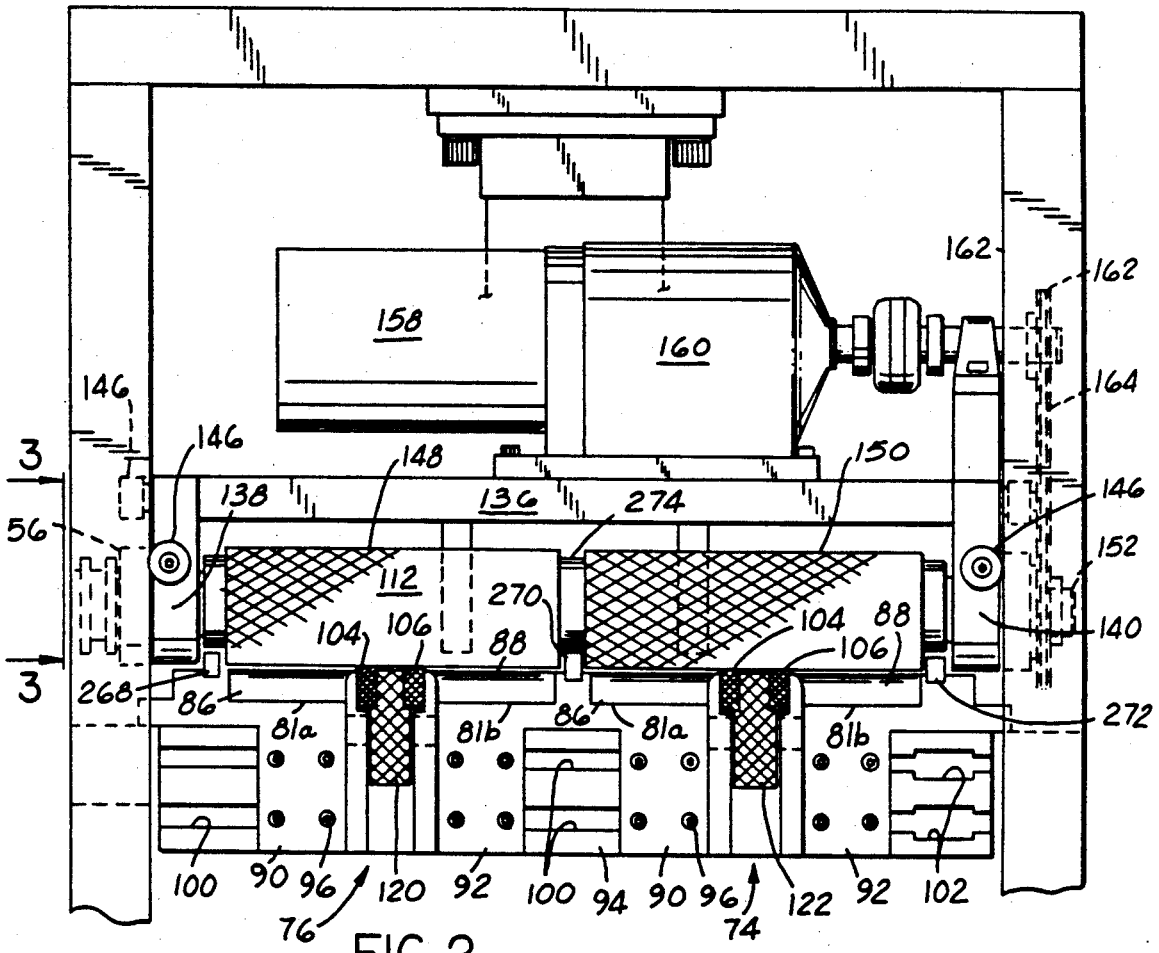
FIG.2
FIG.3
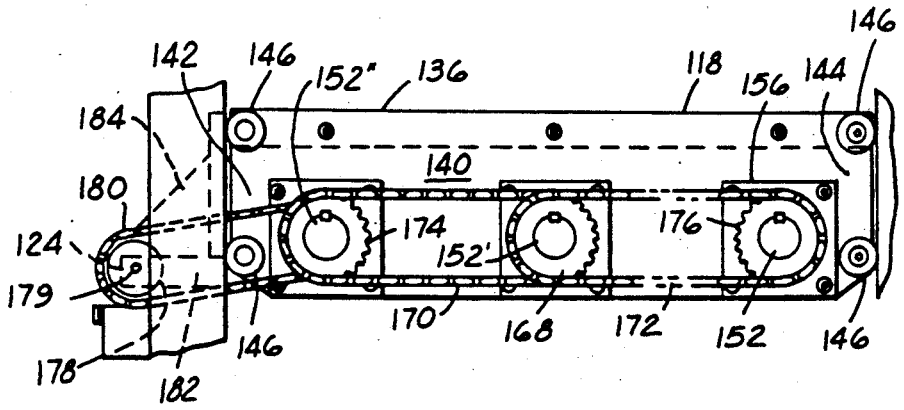

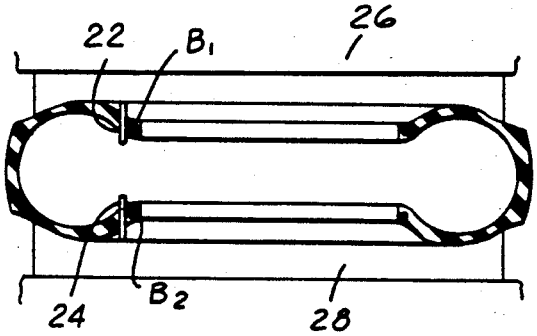
FIG. 9
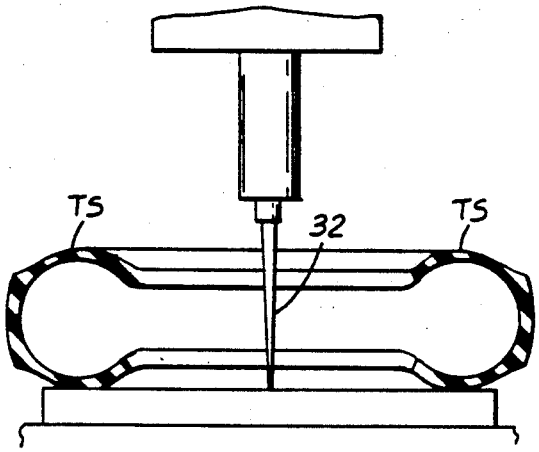
FIG. 10
FIG. 11
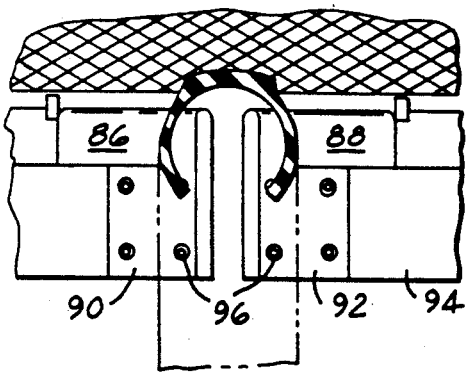
FIG. 12
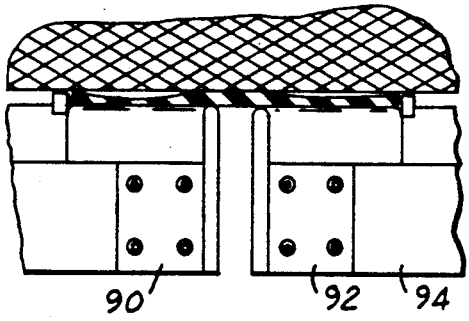
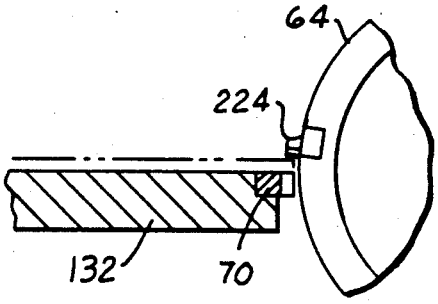
FIG. 13
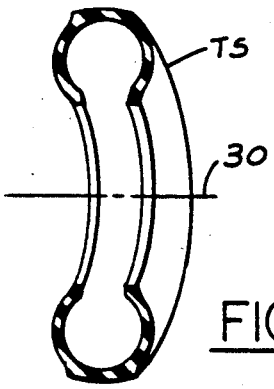
FIG. 14

TIRE CONVERTING APPARATUS AND METHOD

FIELD OF INVENTION

This invention relates to the conversion of automobile and truck tires to small pieces or crumbs for further use or treatment thereof.

BACKGROUND OF THE INVENTION

Despite the efforts of many to devise effective and economical methods and devices for disposing of tires, the problem of disposal remains critical. Not only are piles of worn out tires an eyesore, but recently it has been reported that discarded tires provide breeding ground for mosquitos and possible other disease carriers.

A principal difficulty in reducing or converting tires to a usable form arises from the very toughness of the tires themselves. Purposely designed to withstand abrasion, cutting and other hard usage, the reinforced elastomers are extremely difficult to comminute, shred or otherwise cut up into small pieces or crumbs. The following patents have been issued in the United States dealing with the shredding of tires: U.S. Pat. No. 4,422,581, U.S. Pat. No. 4,052,013, U.S. Pat. No. 4,015,782, U.S. Pat. No. 3,913,850, U.S Pat. No. 3,721,392, U.S. In such shredders, breakage of shredding teeth and rapid wear of the machinery have been principal obstacles.

SUMMARY OF THE INVENTION

I have discovered that the tires may be effectively shredded into small pieces by first removing their beads and then cutting them at least once diametrically to form at least two tire carcass segments, each of conventional U-shape in cross-section. In the case of truck tires, they may be cut diametrically into four carcass segments. Each segment is then progressively opened commencing at one end while flattening it until the entire segment is opened and flat and while holding it in such condition, it is fed against a shredding roll. Apparatus for carrying out the method comprises means for debeading the tires and cutting them and tire segment opening horns disposed at the in-feed end of the tire shredding machine immediately upstream from flattening rollers. As the tire segments are opened up on the horns, they are fed into the machine between in-feed rollers and are flattened and held in the flattened condition as they are fed against a rotating shredding roll. The horns are provided with tire segment guide rollers to prevent skewing of the segments as they pass over the horns and guide plates are provided between the in-feed and flattening rollers to prevent the tire segments from inadvertently creeping upwardly between the rollers. From the shredder, the small pieces or crumbs are conveyed to a separator where the elastomeric particles and the tire cord remnants are separated. From the separation stages the respective portions may be bagged or otherwise handled for further use.

DESCRIPTION OF THE DRAWINGS

In the drawings, protective covers have been removed for ease of illustration of the apparatus.

FIG. 2 is an elevation of the in-feed end of the shredder with a portion partially in section taken along the line 2—2 of FIG. 1;

FIG. 3 is a side elevation of a portion of the chain drive for the in-feed and flattening rollers looking in the direction of arrow 3—3 in FIG. 2;

FIG. 9 is a schematic cross-sectional view through a tire being debeaded;

FIG. 10 is a schematic cross-sectional view through a debeaded tire being cut diametrically;

FIG. 11 shows a tire segment on an opening horn preparatory to being fed to the in-feed and flattening rollers;

FIG. 12 shows the tire segment of FIG. 11 as it is flattened by the in-feed rollers just beyond the opening horn;

FIG. 13 is a fragmentary cross-sectional view taken on line 13—13 of FIG. 4 showing the stationary and movable shredding blades about to mesh;

FIG. 14 is a perspective view of a half tire segment preparatory to being placed on an opening horn for feeding into the shredder.

BRIEF DESCRIPTION OF PREFERRED EMBODIMENT

Figure 15:
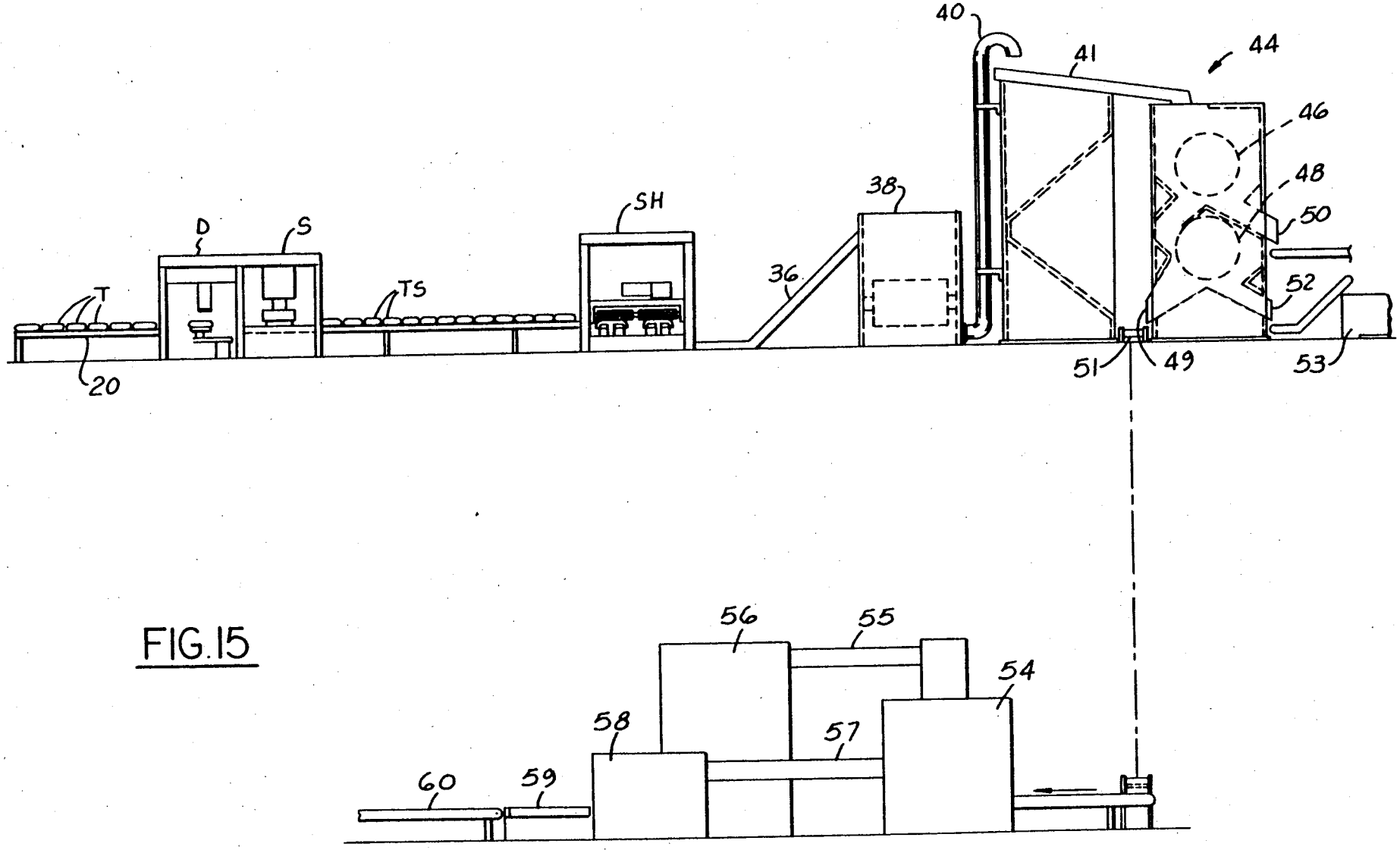
FIG. 15 is a schematic view showing the various stages in the reduction of tires.

Referring to FIG. 15, the overall tire conversion or reduction method is there disclosed comprising an in-feed conveyor 20 on which tires T are placed for delivery to the debeading and segmenting stages, respectively D and S. In the debeading station, the tire beads are cut from the casing. This is schematically shown in FIG. 9 where a pair of blades 22, 24 pierce the sidewall adjacent the bead and then move circumferentially relative to the tire casing to cut the beads $B_1$, $B_2$ therefrom. Details of the tire debeading machine will be disclosed in a separate patent application. Suffice it at this point that the tire is gripped between upper and lower gripping elements 26, 28. The blades and tire are then moved relative to each other to effectively cut the tire circumferentially adjacent each bead. The elements 26, 28 are then opened to release the casing. The tire beads are placed on a separate conveyor or in a suitable storage bin (not shown) for further disposal.

The debeaded casing is then shifted by suitable conveying means from the debeading to the segmenting station, wherein the casing is either cut in half diametrically (in the case of automobile tires), or into four segments (in the case of truck tires). A half tire segment TS is shown in FIG. 14. In the case of a truck tire, this segment would be halved again as on the line 30 in FIG. 15. The segmenting device is shown schematically in FIG. 10, and comprises a blade 32 which extends downwardly piercing the casing and cutting it along a diameter where the plane of the cut substantially coincides with the original axis of the tire. The resulting segment TS is of conventional tire U-shaped cross-section, and, in the case of a segmented automobile tire, would comprise a half circle or a quarter circle in the case of a truck tire.

The tire segments are then fed from the segmenting station on a conveyor 34 to the shredding station SH which is disclosed and described in greater detail hereinafter. Suffice it at this point that the tire segments are reduced to small pieces or crumblike particles by the shredder and are gathered for further handling. In the embodiment shown in FIG. 15, the small pieces or crumbs are conveyed to a granulator mechanism by a conveyor 36. In another embodiment, the debeading, segmenting and shredding stations may be mounted on a flat-bed truck or the like for transport to a site where tires await reduction. In such instance, the crumbs following shredding are gathered for transport to the separating mechanism and further use as desired.

In the embodiment shown in FIG. 15, the crumbs delivered to granulator 38 are further reduced in size and embedded cord fibers or wires pulled therefrom. From the granulator, they are delivered by a pneumatic conveyor 40 to a shaker conveyor 41 to a magnetic separator 44 in which the crumbs fall downwardly over a pair of magnetic drums 46, 48. The elastomer and non-magnetic cord is delivered from the magnetic separator as at 49 for deposit on the conveyor 51 while the steel cord is delivered from the chutes 50 and 52 to a steel scrap container 53. Conveyor 51 delivers the elastomer and non-magnetic cord to a cyclone separator 54 wherein the cord fibers are separated from the elastomer and delivered by the conveyor 55 to a fluff container 56 while the elastomer crumbs are delivered by a conveyor 57 to a bagger 58. The bags may be weighed at a scale 60 and thereafter exit from the system on a conveyor 66. The granulator 38, magnetic separator 44, the various conveyors, the cyclone separator, the bagger and scale are all commercially available items and need not be further described.

Figure 1:
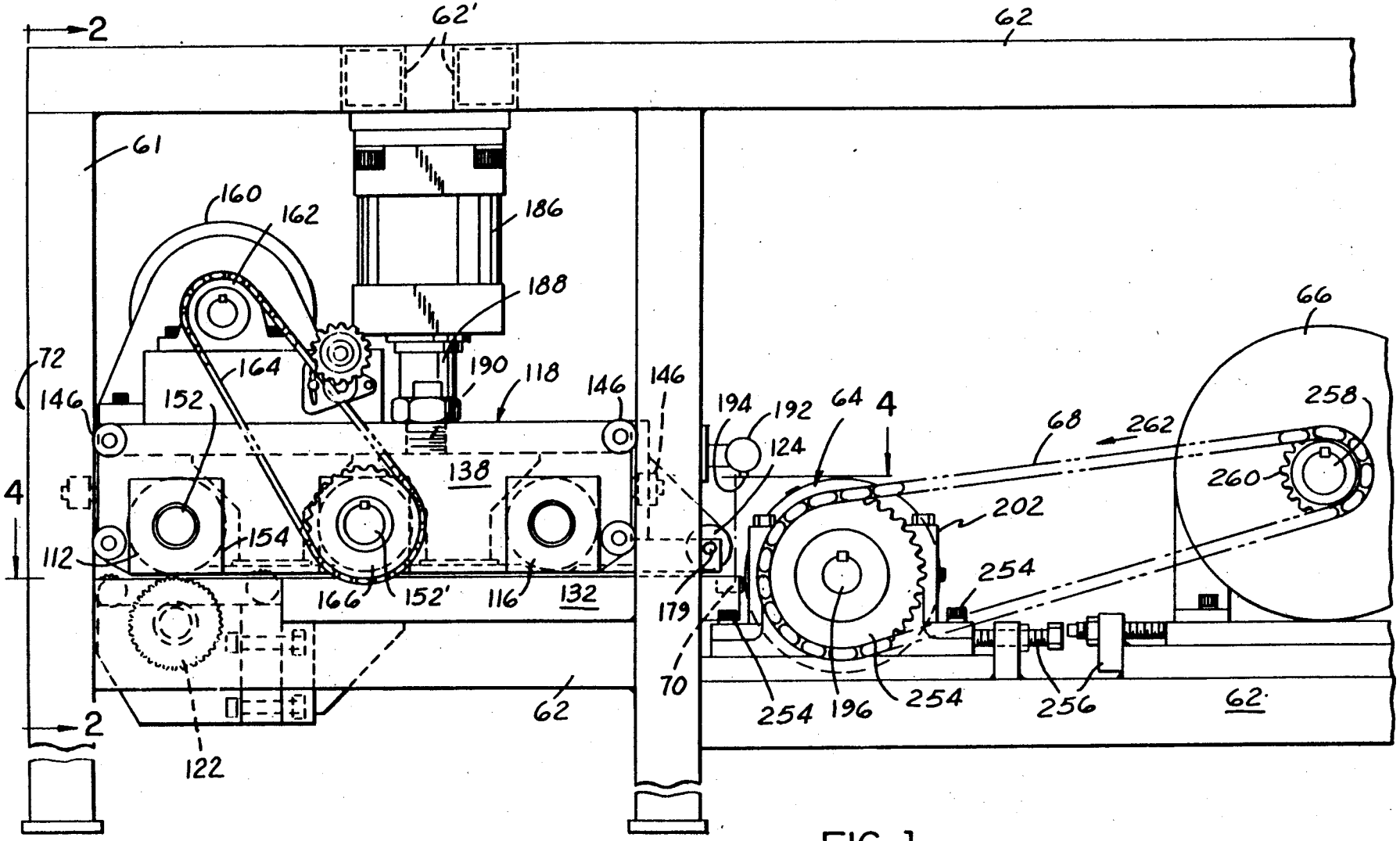
FIG. 1 is a side elevation of a portion of a shredder embodying the invention.

The shredder as shown in FIG. 1, comprises a frame of structural members welded together and adapted to rest on the floor of a building or truck bed. Vertical frame members 61 are connected to horizontal frame members 62. There are means on the frame for shredding tires including a shredding roll 64 driven by a motor 66 through a chain drive 68. The shredding roll cooperates with a stationary blade 70 to shred tire segments fed to the roll as detailed more specifically hereinafter.

Figure 4:
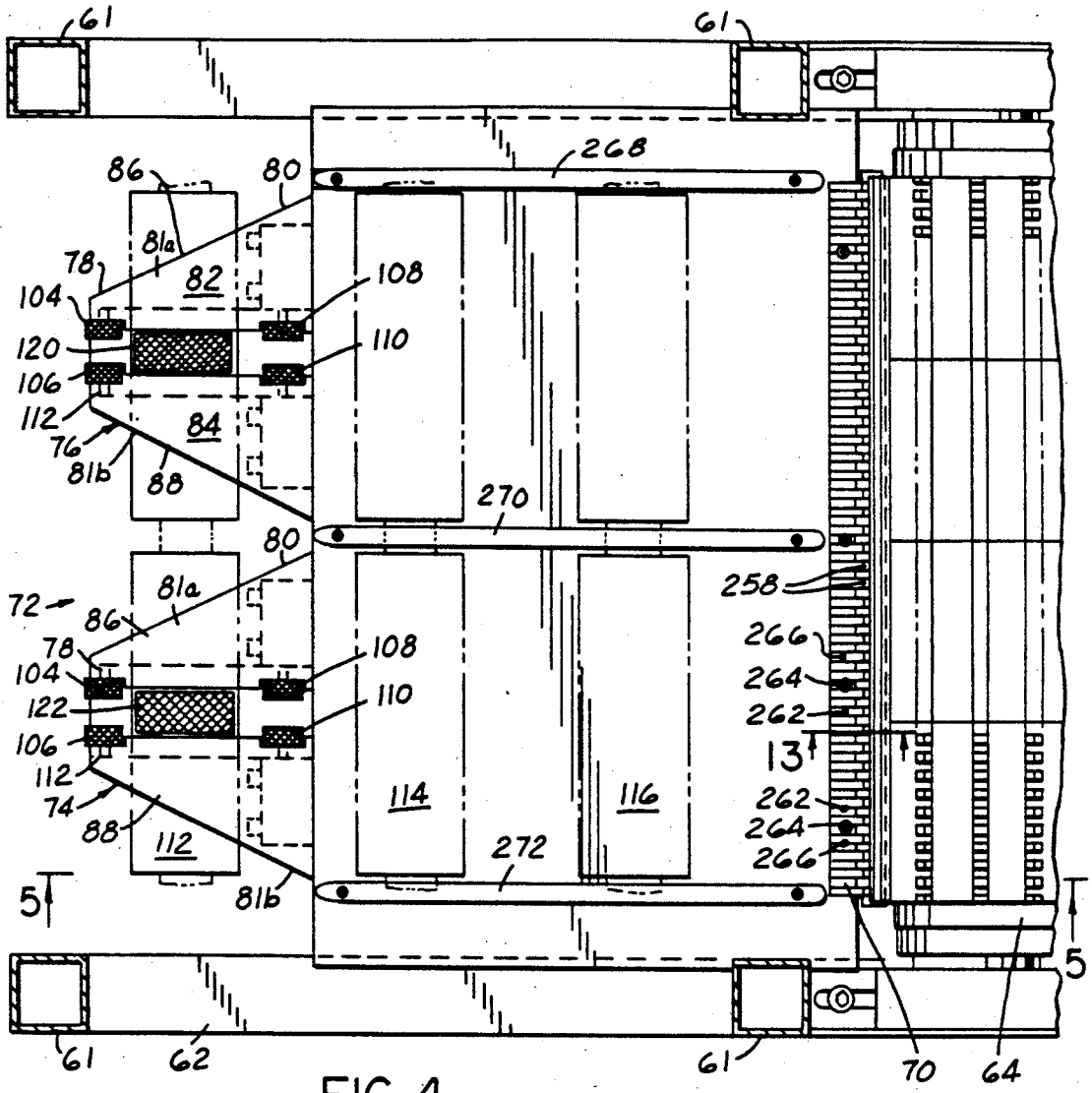
FIG. 4 is a cross-sectional view taken along line 4—4 of FIG. 1.

The machine has a tire segment entry or in-feed end 72, shown in elevation in FIG. 2 and in plan view in FIG. 4. A plurality of tire segment opening horns, two being shown in this embodiment at 74 and 76, are mounted on the frame at the in-feed end of the machine. Each horn has a narrower end 78 and a wider end 80, the later being mounted to the shredder whereby the narrower end is free to receive thereover tire segments to be opened. Each horn comprises a pair of triangularly-shaped members 81*a* and 81*b*, in plan view as shown in FIG. 4, having upper surfaces 82, 84 with rolled over edges 86, 88 and a rear flange 90, 92 (FIG. 2) secured to a transverse frame member 94 by bolts 96 having heads 98 received in T slots 100 in the transverse member (see FIG. 5). The slots and bolts permit the horn halves to be adjusted laterally toward and away from each other to accommodate varying width tires. Each slot may have an enlarged area 102 adjacent one end to permit the reception of the bolt heads 98.

Disposed between the horn members 81*a* and 81*b* of each of the horns 74 and 76 are free-wheeling guide rollers 104, 106, 108 and 110, each having a knurled periphery to engage the inside of the tire segment as it is being fed over the horn to prevent it from skewing. The free-wheeling rollers are mounted on short stub shafts 112 shown schematically in FIG. 4 for the roller 106 which are secured to the horn members. It will be noted that one pair of rollers, i.e., 101, 106 is mounted adjacent the free end 78 of each horn, while the pair 108, 110 is mounted adjacent the wider end of each horn.

Figure 5:
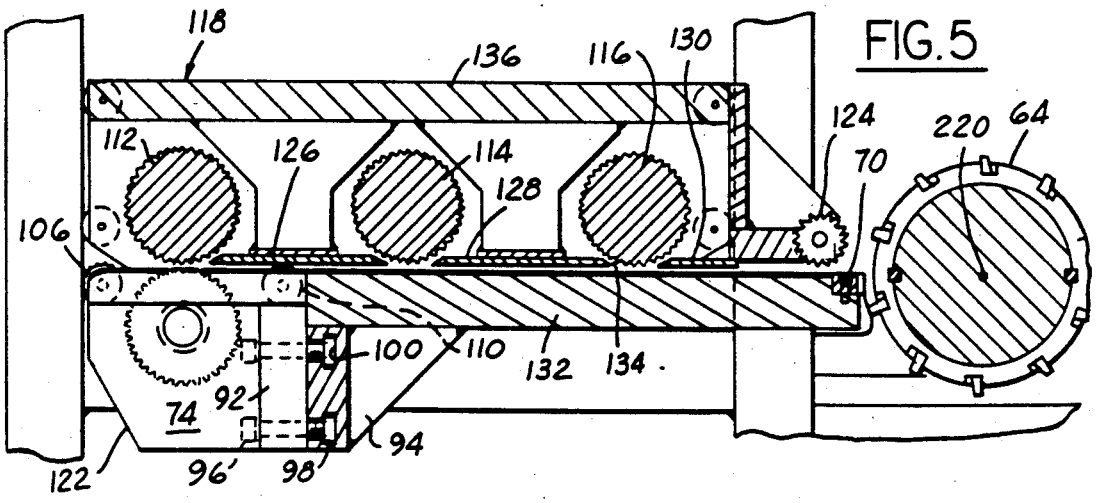
FIG. 5 is a cross-sectional view taken along line 5—5 of FIG. 4.

Between the horns and shredding roll 64 are three feeding and flattening rollers 112, 114, and 116 supported in a vertically movable carriage 118. Roller 112 is disposed immediately superjacent the horns and cooperates with in-feed idle rollers 120 and 122 mounted on stub shafts on each horn between the horn members 81*a* and 81*b* as shown in FIGS. 2, 4, and 5. Rollers 112, 114, 116, 120 and 122 are provided with deeply knurled peripheral surfaces to facilitate gripping of the tire carcasses. The roller 112 is an in-feed roller adapted to draw a tire casing segment over the horns opening the tire commencing at one end and as it is opened commencing to flatten it as it feeds into the shredder. The roller 114 picks up the tire segment which has been fed in by the roller 112 and serves to hold it in a flattened condition as the roller feeds the flattened tire segment toward the shredding roll 64. Roller 116 in turn picks up the leading edge of the flattened tire segment and feeds it beneath the pressure roller 124 disposed immediately adjacent the stationary blade 70 as best shown in FIG. 5. Intermediate rolls 112, 114, 116, and 124, are guide plates 126, 128 and 130 for preventing tire segments from creeping up into the space between the rolls and jamming in the shredder.

The rollers and guide plates are supported on the carriage 118 for vertical movement within the machine frame toward and away from a supporting table 132. The surface of the table may be provided with an abrasion resisting slippery layer 134 of Teflon or the like which extends to the stationary blade 70. The carriage 118 includes an upper horizontal plate 136 with depending side plates 138 and 140 and depending end plates 142 and 144. A plurality of guide rollers 146 bear against the frame of the machine to guide the carriage 118 for vertical movement.

The rollers 112, 114, and 116 are similarly constructed and mounted in the carriage and a description of roller 112 will suffice for all. Roller 112 has a left hand and right hand portion 148 and 150 integral with a shaft 152 carried at opposite ends by bearing blocks 154 and 156 secured to the side carriage plates 138 and 140. Mounted atop plate 136 is a feed motor 158 operating through a speed reducer 160 to drive a sprocket 162 and in turn a chain drive 164. The chain is entrained over a sprocket 166 keyed to the end of shaft 152' of the roller 114. Keyed to the opposite end of the shaft 152' are a pair of chain sprockets, the outer one of which is indicated at 168 in FIG. 3 with the two sprockets having a pair of drive chains 170 and 172 entrained thereover. Such chains are entrained at the opposite end over drive sprockets 174 and 176 keyed to the ends of shafts 152 and 152'' to drive them as shaft 152' is driven. Pressure roller 124 is driven from the aforementioned chain drive by a sprocket 178 keyed on the shaft 179 and over which is entrained the drive chain 180 which is entrained at its opposite end over a sprocket (not shown) keyed to the shaft 152" adjacent the sprocket 174 shown in FIG. 3. Pressure roller 124 is mounted on carriage brackets 182 secured to the end plate 142 of the carriage and provided with reinforcing gussets 184. Suitable bearings are provided for carrying shaft 179 on the bracket 182.

Vertical movement of the carriage 118 is provided by a fluid pressure cylinder 186. Under 186 suspended at its upper end from transverse frame members 62' and having a piston rod 188 threadedly connected at 190 to the upper plate 136 of the carriage. A source of fluid pressure (not shown) is connected to the cylinder 186 to cause it to raise and lower the carriage as desired. The position of the carriage may be adjusted to accommodate the thickness of the tire segments being fed into the shredder and the pressure applied to the segments by the pressure roller 124 as they reach the stationary blade 70.

Elastomer lubricating means are provided at the stationary blade to wet the elastomer and facilitate its shredding. Such means may comprise a pipe 192 extending transversely of the shredder just above the stationary blade 70 and having a series of nozzles 194 for spraying liquid down onto the tire segments as they pass over the stationary blade and against the rotating shredder roll 64. A suitable source of lubricating fluid (not shown) is connected to the pipe 192. A suitable lubricant may comprise water, or water with a wetting agent therein plus a rust inhibitor.

Figure 6:
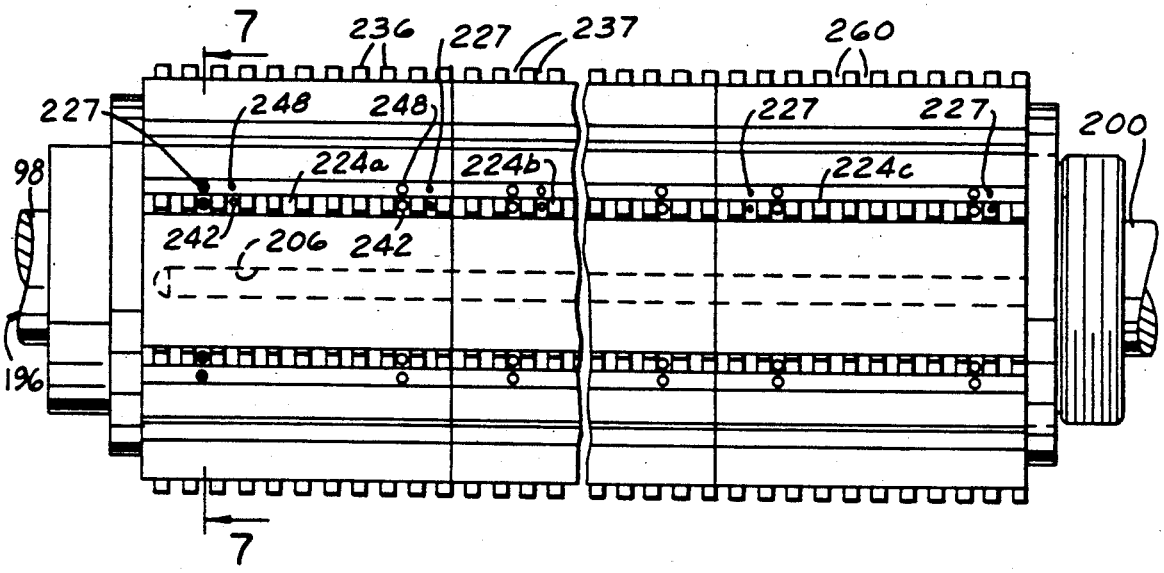
FIG. 6 is an elevational view of the shredding roll.
Figure 7:
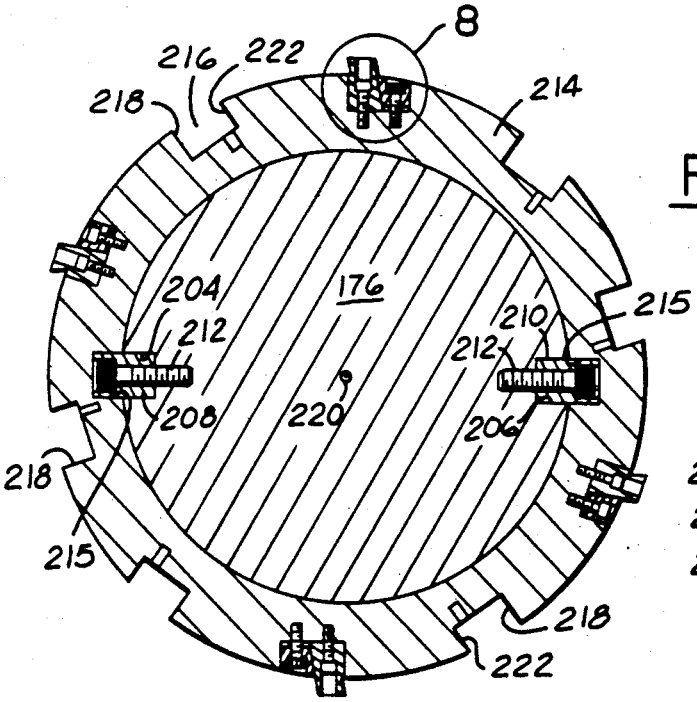
FIG. 7 is a cross-sectional view taken along line 7—7 of FIG. 6.
Figure 8:
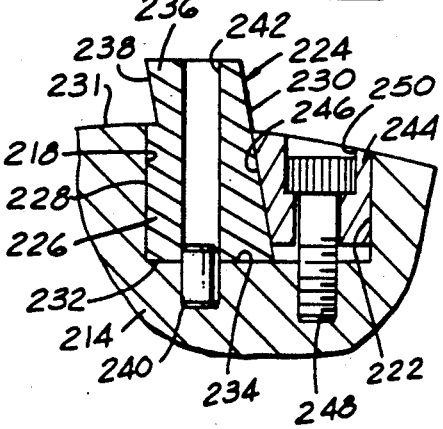
FIG. 8 is a fragmentary exploded view of a cutter as at detail 8 in FIG. 7.
Figure 8A:
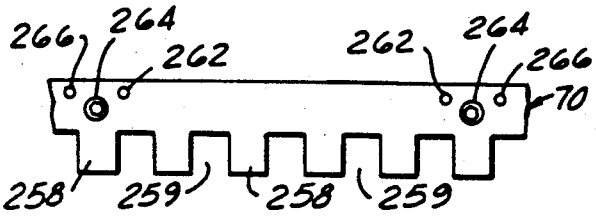
FIG. 8*a* is a fragmentary plan view of the stationary blade showing a locator pin, a pair of retaining bolts and jack-screw holes.

The shredding roll 64 comprises, as best shown in FIGS. 6, 7, and 8, a roll shaft 196 having reduced diameter end portions 198 and 200 adapted to be carried by pillow blocks 202 (one of which is shown in FIG. 1) mounted on the frame 62. The shaft 196 is diametrically provided with keyway slots 204 and 206 which extend axially of the shaft for receiving therein elongated keys 208 and 210 held in place by suitable bolts or the like 212. Slidably received over the shaft 196 is the cutter drum 214 internally provided with diametrical keyways 215 to receive the keys 208 and 210 to prevent relative rotation between the drum and the shaft. Exteriorally the drum is provided with a plurality, in this case 10, axially extending circumaxially equally spaced cutter-blade receiving notches 216 for receiving the cutter blades hereinafter described. Each of such notches has a leading face 218 lying in a plane common to the axis 220 of shaft 196 and a trailing face 222 displaced angularly from the leading face a distance to enable the reception of the cutter blades and their locking wedges.

In each of the ten slots 216, there are received the cutter blades 224 shown in cross-section in FIG. 8. The blades are arranged end to end, the number depending upon the convenient length in which to make the blade. In FIG. 6, cutter blade segments **224*a*, 224*b*, and 224*c* are shown in one of the slots 216. Each of the blades comprises a base portion 226 having a face 228 adapted to mate with the leading face 218 of the slot and a tapered trailing face 230. The bottom surface 232 of the blade abuts the bottom 234 of the slot. The blade further has a series of spaced apart, outwardly-projecting cutter heads 236 having notches or gaps 237 therebetween and an inclined leading face 238 sloping from its outer end away from the plane of the leading face 228 of the base 226 and forming a slight overhang with respect to the base. A plurality of locating pins 240 are pressed into the barrel slots 216 and have a slip fit with a bore 242 in the blade. The pins 240 provide for accurate location of the cutters in the slots so that the heads 236 will be insured of accurately meshing with the complementary cutter heads in the stationary blade 70**.

The cutter blades are held in place in the roll by locking wedges 244 which extend along the backside or trailing face 230 of the cutters. Each wedge has a tapered face 246 abutting the tapered rear face 230 of the blade and is so proportioned that it does not reach the bottom 244 of the cutter slot 216 when securely fastened therein. The wedge is held in place by a plurality of bolts 248 having a head disposed in a counter-bore 250 in the wedge. The bolt is tightened against the bottom of the counter-bore to urge the wedge downwardly in the slot 216 to thereby lock the cutter blade 224 in the slot. Removal of the wedges and cutter blades from the roll is effected using jack-screws.

The cutter blades 224 may be formed of any suitable material such as steel, carbide, diamond-faced metals and the like. One particularly suitable material is DPM Rex 20, a trademark of Crucible Steel, Rochester, New York, for a powder metal material. This is teat-treated to Rockwell 65–68° C. and then subjected to a cryogenic treatment. Coatings of titanium or carbide may be applied, or the blade may be subjected to a Dynablue process to enhance blade life.

On one of the ends of shaft 196 is mounted and keyed a sprocket 254 upon which the chain 68 is entrained. The pillow blocks 202 are held to the frame 62 by bolts or the like, 254, and adjustment of the chain drive 68 may be effected by conventional tightening means 256 comprising threaded members mounted in fixed blocks bearing against the base of the pillow blocks and motor 66. The motor shaft 258 is provided with a suitable sprocket 260 upon which the chain 68 is entrained. Rotation of the motor is such as to drive the chain in direction of arrow 262 so that in FIG. 1 the shredding roll 64 moves in a counter-clockwise direction.

Figure 8B:
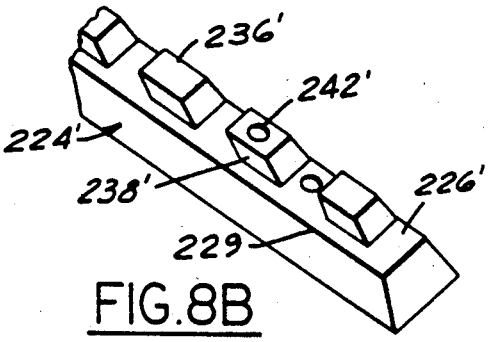
FIG. 8*b* is a fragmentary perspective view of a modified form of a blade used in the shredding roll.

A modified form of the cutter blade is shown at 224' in FIG. 8B. In this embodiment, portions corresponding to portions in the previously described blade are indicated by primed reference numerals. The base 226' has a greter vertical dimension so that edge 229 projects beyond the peripheral surface 231 of the drum 214 (see FIG. 8) and becomes a cutting edge cooperating with the stationary blade 70. The cutter heads 236' are set back from edge 229. This modified form of the blade appears to give an improved cutting action eliminating any tendency to form strings.

The stationary blade 70 complements the blades of the roll 64 as best shown in FIG. 4. The stationary blade 70 may, as in the case of the blades in the roll 64, consist of a plurality of blade segments arranged in end-to-end relation at the edge of table 132. As shown in FIG. **8*a*, each of the segments includes a plurality of laterally spaced-apart cutter heads 258 which fit in the gaps or notches 237 between complementary heads 236 of the blades in roll 64. Notches 259 are formed between the heads 258, similar to the notches 260, between the heads 236 of the roll. Clearance between the heads and sides of the notches of the complementary blade may be on the order of 0.010 inches. Locator pins 262 extend through the cutter blades of the cutter 70 to accurately located the cutter on the bed and bolts 264 serve to secure the cutters to the bed 132. Threaded holes 266 are adapted to receive jack screws (not shown) when it is desired to remove the blade from the bed 132. The jack screws are threaded into holes 264 and the lower end of the screws bear against the bed 132 to force the blade upwardly off the locator pins. Of course, the jack screws are removed from the blade except when it is desired to remove the blade. The center 220 of the roll 64 coincides with the plane of the surface 134 of the bed 132**.

I have found that satisfactory shredding may be accomplished where the roll is turned at a speed of 600 rpm with the tire segments being fed against the roll at a speed of 24 inches per minute. Feeding tire segments over both horns at the same time, four passenger tires may be shredded per minute. Speed of feeding may be varied to suit the thickness of the tire segments being shredded. Height of the carriage 118 may also be varied in accordance with the thickness of the tire segments. However, it is important that particularly as the flattened tire segment reaches the cutting interfaces of the stationary and rotary blades it be kept flat and therefor the pressure roll is vertically adjusted to maintain such flattened condition at this critical point. Similar to the feed rollers 112, 114, and 116, the pressure roller 124 may be provided with a coarsely serrated surface to grip the tire segments and promote both feeding and prevent skewing.

As shown best in FIGS. 2 and 4, tire segment guide nails 268, 270, and 272 are provided on the shredder bed 132 to prevent skewing and to guide the segments toward the shredder roll. Rail 270 is disposed in a gap 274 between the left and right roller segments 148 and 150 as shown in FIG. 2.

What is claimed is:

1. The method of converting tires comprising the steps of:

debeading the tires;

cutting each tire diametrically into at least two segments;

commencing at one end of each segment, spreading the sidewalls apart while the segment;

while holding the segment flattened, shredding it progressively from one end to the other; and recovering the shredded pieces for further use.

2. The invention defined by claim 1 wherein the tire is cut diametrically into four separate segments and each is flattened prior to shredding.

3. The invention defined by claim 1 wherein following shredding, metallic cord elements are separated from elastomeric elements.

4. The invention defined by claim 1 wherein following shredding, cord elements are separated from elastomeric elements.

5. The invention defined by claim 1 wherein following shredding, metal cord elements and non-metallic cord elements are separated from elastomeric elements.

6. The invention defined by claim 1 wherein each tire segment is fed in its flattened condition longitudinally toward and against a shredding roll.

7. Apparatus for shredding tires comprising, in combination:

a shredding roll;

power driven in-feed rollers;

flattening rollers disposed between the in-feed rollers and the shredding roll for receiving a tire segment from the in-feed rollers and feeding it in flattened condition to the shredding roll; and an opening horn disposed immediately before the in-feed rollers, and having diverging sides for opening a debeaded tire segment as it is fed over the horn to the in-feed rollers.

8. The invention defined by claim 7 wherein the horn is provided with guide roller means at the end remote from the in-feed rollers for preventing skewing of a tire segment fed over the horn.

9. The invention defined by claim 7 wherein said horn is provided with guide rollers at both ends remote from and adjacent the in-feed rollers for engaging a tire segment being fed over the horn to prevent skewing.

10. The invention defined by claim 8 or 9 wherein the guide rollers are provided with tire-gripping surfaces.

11. The invention defined by claim 8 wherein said guide roller means comprises free-wheeling rollers.

12. The invention defined by claim 7 wherein the diverging sides of the horn are supported for lateral displacement to adjust the horn width for the size tire segment being fed.

13. The invention defined by claim 7 wherein there is a power driven in-feed roller disposed superjacent the horn for feeding a tire segment over the horn.

14. Apparatus for shredding tires comprising, in combination:

a frame;

means on the frame for shredding tires including a stationary blade and a cooperating moving blade;

a tire segment opening horn having a narrow end and an opposite wider end mounted on the frame with the narrow end projecting free to receive a U-shaped tire segment thereon for opening the same;

a power-driven in-feed roller disposed superjacent a horn to grip a tire fed over the horn and draw it toward the shredding means;

a guide roller disposed in the horn opposite the in-feed roller; and flattening rollers disposed between the horn and the means for shredding tires for receiving tire segments opened on the horn and flattening them and feeding them to said means.

15. The invention defined by claim 14 wherein guide plates are disposed between the in-feed and flattening rollers to prevent tires from creeping upwardly between the rollers.

16. The invention defined by claim 15 wherein guide plates are disposed between the flattening rollers to prevent tire from creeping upwardly between the rollers.

17. The invention defined by claim 14 wherein said in-feed and flattening rollers are mounted in a vertically movable carriage with means for urging said carriage downwardly toward tire segments passing beneath the rollers.

18. The invention defined by claim 17 wherein a pressure roller is provided on said carriage disposed immediately adjacent said stationary blade for maintaining a tire segment flat as it reaches the blades.

* * * * *

UNITED STATES PATENT AND TRADEMARK OFFICE

CERTIFICATE OF CORRECTION

PATENT NO. : 5,024,386

DATED : June 18, 1991

INVENTOR(S) : Alvin L. Morris

It is certified that error appears in the above-identified patent and that said Letters Patent is hereby corrected as shown below:

Claim 1, Column 7, Line 40, after "while" insert "flattening".

Signed and Sealed this

Twentieth Day of October, 1992

*Attest:*

DOUGLAS B. COMER

*Attesting Officer*

*Acting Commissioner of Patents and Trademarks*